United States Patent [19]

Frei

[11] Patent Number: 4,795,105

[45] Date of Patent: Jan. 3, 1989

[54] PACKAGE SUPPORT DEVICE FOR THE INTERMEDIATE STORAGE OF WOUND-UP PRINTED PRODUCTS, SUCH AS NEWSPAPERS, PERIODICALS AND THE LIKE

[75] Inventor: Hans Frei, Oetwil am See, Switzerland

[73] Assignee: Ferag AG, Hinwil, Switzerland

[21] Appl. No.: 162,949

[22] Filed: Mar. 2, 1988

[30] Foreign Application Priority Data

Mar. 4, 1987 [CH] Switzerland ..... 00807/87

[51] Int. Cl.[4] ..... B65H 75/18; B65B 63/00

[52] U.S. Cl. ..... 242/59; 242/68.5; 53/118

[58] Field of Search ..... 242/59, 68.5; 53/118, 53/430

[56] References Cited

U.S. PATENT DOCUMENTS

| | | | |
|---|---|---|---|
| 4,528,794 | 7/1985 | Thierstein | 53/118 |
| 4,532,750 | 8/1985 | Meier | 242/59 X |
| 4,542,863 | 9/1985 | Larson | 242/96 |
| 4,550,883 | 11/1985 | Boss | 242/59 |

FOREIGN PATENT DOCUMENTS

| | | |
|---|---|---|
| 809695 | 8/1951 | Fed. Rep. of Germany . |
| 2106872 | 4/1983 | United Kingdom . |

*Primary Examiner*—Stanley N. Gilreath
*Assistant Examiner*—Steven M. duBois
*Attorney, Agent, or Firm*—Werner W. Kleeman

[57] ABSTRACT

The package support device comprises a hollow cylindrical rotatable winding core member possessing a substantially cylindrical support surface for the wound-up printed products. At the winding core member there is formed a ring-shaped groove extending in the circumferential direction of the winding core member and open towards the outside. Accommodated within such ring-shaped groove is a winding band wound upon the winding core member. The ring-shaped groove can be covered by a cover member supported at the winding core member. This cover member rotates with the winding core member and is displaceable in the direction of the lengthwise axis of such winding core member in order to expose the ring-shaped groove. The cover member can also be constructed to be rotatable in relation to the winding core. A throughpass opening for the winding band is formed in the cover member.

21 Claims, 4 Drawing Sheets

E
8a
1
3
4
7a
8
2
7
2a
7'
2b
2b
6

1
5
B
3
8
2a
7
10
6

17
17'
15a
16
16
17
16
3
8
4
7
2
2a
6

15
6
17'
17

3
4
8
B'
11
1
7
2
2a
A
10
11
6

1
8
10
10
2
2a
7'
10
10
9
13
12
14
6

PACKAGE SUPPORT DEVICE FOR THE INTERMEDIATE STORAGE OF WOUND-UP PRINTED PRODUCTS, SUCH AS NEWSPAPERS, PERIODICALS AND THE LIKE

BACKGROUND OF THE INVENTION

The present invention relates to a new and improved construction of a package support device, also sometimes referred to as a package support or carrier, for the intermediate storage of wound-up products, typically printed products, and especially although not exclusively newspapers, inserts, periodicals, magazines and the like.

Generally speaking, the package support device for the intermediate storage of wound-up printed products, particularly, for example, newspapers, inserts, periodicals, magazines and the like, as contemplated by the present development, is of the type comprising a winding core member possessing a substantially cylindrical support or bearing surface for the wound-up printed products or the like. Upon the winding core member there is wound a winding band or tape, also sometimes referred to in the art as a winding strap, which is connected at one end thereof with the winding core member. This winding band or tape is accommodated in a substantially ring-shaped or annular groove-like recess or depression which extends in the circumferantial direction of the winding core member and which is open in the direction of the product support or bearing surface.

A winding unit or device is known to the art from Swiss Pat. No. 652,379 and the cognate U.S. Pat. No. 4,532,750, granted Aug. 6, 1985 and the British Published patent application No. 2,106,872, published Apr. 20, 1983. Such winding unit or device comprises a hollow cylindrical winding body upon which the printed products are wound up in an imbricated or shingled formation. Within the winding body there is arranged a supply spool for the winding band or tape. This winding body is supported by rib members upon a continuous shaft which protrudes past the winding body. The supply spool for the winding band or tape is rotatably mounted upon the shaft. Co-rotating with the supply spool is a drive wheel or gear which, likewise, is mounted upon the shaft and can be brought into contact with a pivotably mounted friction wheel in order to rotate the band supply spool. At the winding body there is provided a slot through which there can pass the winding band or tape arranged internally of the winding body.

The winding band or tape is always transported and stored in conjunction with the winding body. Prior to winding-up printed products, the required winding band or tape length is paid-off the supply spool and wound-up upon a band or tape spool arranged externally of the winding body for achieving an intermediate storage of such paid-off winding band length. During winding-up of the printed products, the winding band or tape is withdrawn from the band or tape spool and wound-up in conjunction with the printed products onto the winding body. The length of winding band which is not required to be used remains wound-up upon the supply spool.

The construction of this heretofore known winding unit or device is considered to be rather complicated which, in turn, renders more expensive its fabrication. This is particularly of significance when considering the fact that in a printing plant a large number of such winding units or devices are required. Additionally, such construction of winding unit or device requires a great deal of space in the direction of the shaft since such shaft, of course, laterally protrudes beyond the winding body. Moreover, for the unwinding of the winding band or tape from the supply spool there is needed a separate drive which must be provided in addition to the drive provided for the winding body.

In the pre-published European Published patent application No. 0,236,561, first published on Sept. 6, 1987, and the commonly assigned cognate U.S. application Ser. No. 07/005,698, filed Jan. 22, 1987, of Werner Honegger, and entitled "Method of, and Apparatus for, Interim Storing of Printed Products, Typically Newspapers, Periodicals and the Like, Arriving in an Imbricated Product Formation", there is disclosed a package support device of the previously mentioned type which is simpler in construction and easier to handle than the previously discussed winding unit or device. With this construction of package support device, the outwardly open ring-shaped or annular groove, within which there is accommodated or housed the winding band or tape, is laterally offset. In this way, there is achieved the result that during winding-up of the printed products the winding band or tape which is wound-up between the individual printed product convolutions or coils does not come to lie above the ring-shaped or annular groove. This beneficially avoids pressing of the printed products into the ring-shaped or annular groove.

However, this proposal is afflicted with the shortcoming that the winding-off of the winding band or tape from the winding core member is not accomplished in the same plane as the subsequent winding-up of the winding band or appropriate guiding of the winding band or tape is required during the time that it is wound-off of the winding core member and it is wound on to a winding band spool provided at the wind-up station.

SUMMARY OF THE INVENTION

Therefore with the foregoing in mind it is a primary object of the present invention to provide a package support device for the intermediate storage or wound products, such as printed products, typically although not exclusively, newspapers, inserts, periodicals, magazines or the like, in a manner which does not suffer from the aforementioned drawbacks and shortcomings of the prior art constructions.

Another and more specific object of the present invention is directed to a new and improved construction of a package support device of the previously mentioned type which is of simple and space-saving construction, and also can be handled or manipulated with very little or modest effort and equally stored without any great problem.

Yet a further significant object of the present invention, is concerned with a new and improved construction of a package support device for the intermediate storage of wound-up printed products, such as newspapers, inserts, periodicals, magazines and the like, wherein the package support device contains a winding band or tape which is accommodated thereat in a manner such that during use of the package support device there is effectively precluded, or at least substantially minimized, the occurrence of detrimental effects or damage to the wound-up printed products.

A further noteworthy object of the present invention is concerned with a package support device onto which there can be wound-up and from which there can be instance, newspapers, inserts, periodicals, magazines and the like, which package support device is relatively simple and , space-saving in its construction, quite easy to use, can be stored in an efficient and space-saving manner, handled and manipulated without any great difficulties, is not readily subject to breakdown or malfunction and requires a minimum of maintenance and servicing.

Now in order to implement these and still further objects of the invention, which will become more readily apparent as the description proceeds, the package support device of the present development is, among other things, manifested by the features that a cover or closure member is provided at the winding core member which allows for winding, either winding-up or unwinding or winding-off, the winding band or tape, also sometimes referred to as a strap. This cover member or closure serves to cover the opening of the substantially ring-shaped recess.

As will be evident from the description to follow, and thus as should be understood when using the terms "cover member" or "closure member" and its coaction with the substantially ring-shaped recess or groove or equivalent structure, such need not fully cover all portions of such substantially ring-shaped recess or groove. Apart from the fact that there is provided a throughpass opening or passage in the cover or closure member through which there can pass the winding band or tape or the like, the cover or closure member can be constituted, for instance, by an interrupted or non-continuous member or by any other suitable or equivalent constructions fulfilling the purposes and objectives of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figures 1, 2, 3, 4, 5, 6:
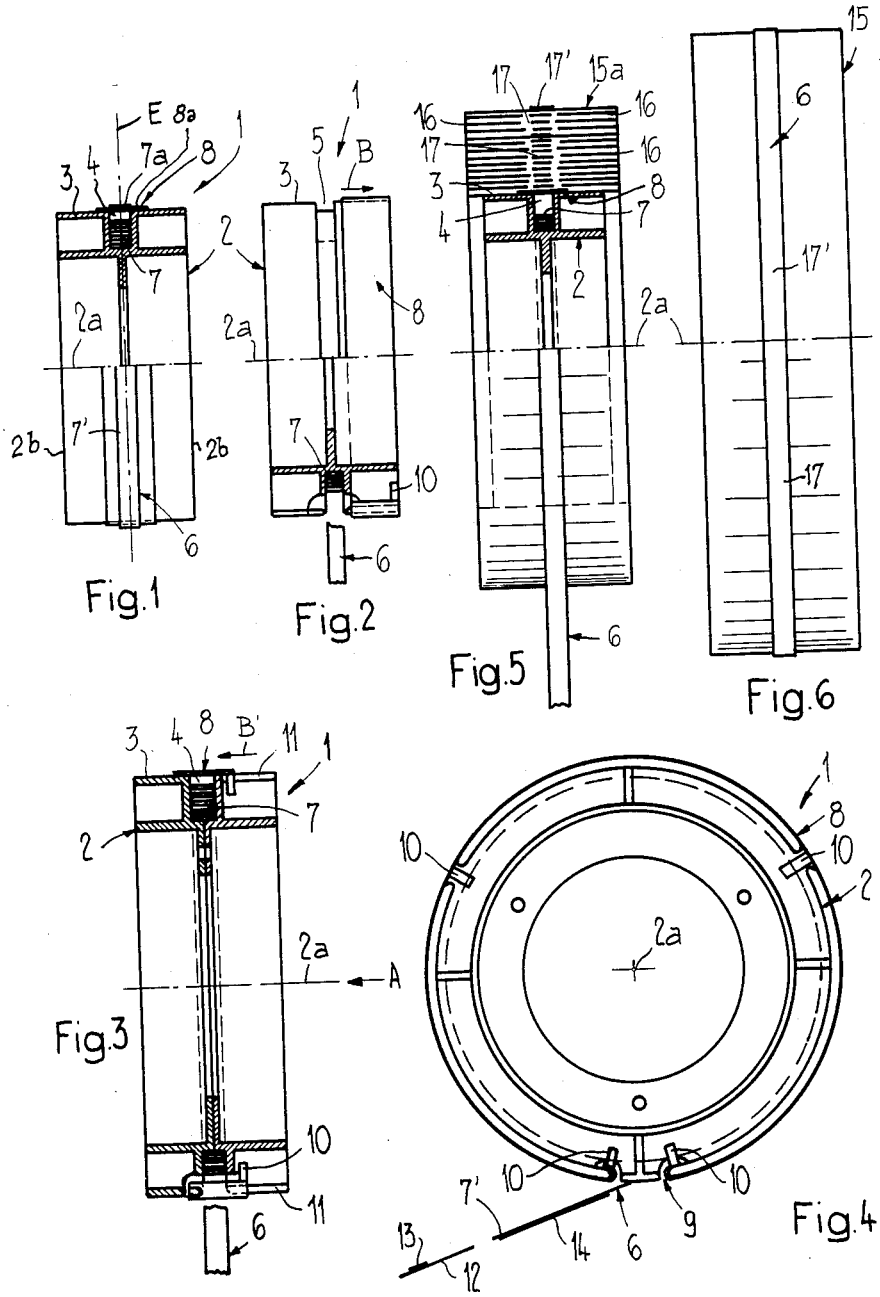
FIG. 1 is a side view, partially in section, of a first exemplary embodiment of a package winding support device.
FIG. 2 again illustrates in side view and partially in section, the first exemplary embodiment of package winding support device of FIG. 1, depicting the same with the cover or closure member laterally shifted to freely expose the opening of the substantially ring-shaped recess or groove.
FIG. 3 again illustrates in side view and partially in sectional view the first exemplary embodiment of package support device, illustrating the cover or closure member in overlying relationship to the ring-shaped recess or groove and depicting the package support device on a somewhat larger scale than shown in FIGS. 1 and 2.
FIG. 4 is a side view, looking in the direction of the arrow A of FIG. 3, of the package support device depicted therein.
FIG. 5 illustrates in side view and partially in sectional view the package support device illustrated in FIGS. 1 to 4 but this time bearing a portion of the wound-up printed products which are being wound thereon.
FIG. 6 illustrates the arrangement of FIG. 5 in side view and portraying the completed wound-up printed product and part of the last convolution or coil of the wound-up winding band or tape.

Describing now the drawings, it is to be understood that only enough of the package support device and the winding station with which the same may be used by way of example and not limitation have been shown in the drawings, to simplify illustration thereof and as needed for those skilled in the art to readily understand the underlying principles and concepts of this invention.

Turning now attention initially to FIGS. 1 to 4 of the drawings, the exemplary embodiment of package support or carrier device 1 will be seen to comprise a hollow substantially cylindrical rotatable winding or package core or mandrel member 2, the lengthwise axis of which has been conveniently designated by reference character 2*a*. The jacket or outer surface of this winding core member 2 is constructed as a substantially cylindrical support or bearing surface 3. Furthermore, it will be observed that at the winding core member 2 there is provided a recess or groove 4 in the form of a substantially ring-shaped or annular groove which is open towards the outside, in other words is open in the direction of the substantially cylindrical support or bearing surface 3.

The recess or groove opening or mouth of this substantially ring-shaped recess or groove 4 has been generally designated by reference character 5 in FIG. 2. This ring-shaped recess or groove 4 is located approximately at the center or median region disposed between the end surfaces or faces 2*b* of the winding core or core member 2 and is located in the central or median plane, generally designated by reference character E. This central or median plane E extends substantially at right angles or orthogonally with respect to the lengthwise axis 2*a* of the winding core member 2. In this substantially ring-shaped recess or groove 4 there is arranged or accommodated a winding band or tape 6 which is wound onto or at the winding core member 2 and which has one end thereof appropriately connected with such winding core member 2. The individual convolutions or coils of the winding band or tape 6 which have been wound onto or at the winding core member 2 are designated by reference numeral 7.

The substantially ring-shaped recess or groove 4 is covered by means of a substantially ring-shaped cover or closure member 8 which is retained at the winding core member 2. This cover or closure member 8, in turn, is not itself completely closed or continuous, so that there is left free of a throughpass opening or passage 9 for the winding band or tape 6, as the same has been particularly well shown in FIG. 4. The cover or closure member 8 is displaceable in the direction of the lengthwise axis 2*a* of the winding core member 2, in other words, selectively in the direction of the arrows B and B' of FIGS. 2 and 3, respectively. Extending from the cover member 8 are the lugs or dogs 10 or equivalent structure which engage in guide slots or openings 11 provided at the winding core member 2, as particularly evident by inspecting FIG. 3. By means of these lugs or dogs 10 the cover member 8 is guided in the guide slots 11 in the aforenoted displacement directions B and B' or axial direction of extend of the winding core member 2 and, additionally, is here secured against rotation with respect to the winding core member 2. This means that in this embodiment under discussion the cover member 8 co-rotates along with the winding core member 2.

The free end 12 of the winding band or tape 6, located opposite to the band end secured to the winding core member 2, is provided with one fastening or closure part or portion 13 of a suitable fastening or closure device 13, 14, typically for instance, a so-called burr fastener or closure device, in other words the type of well known fastener device composed of hooks and loops, as the same is generally referred to as "Velcro" fasteners. The other closure part or portion 14 of such burr fastener or closure device 13, 14, is located at a spacing from the free band end 12 at the outer situated side of the wound-up winding band or tape 6, as the same has been depicted in FIG. 4. The spacing of this other fastener or closure part or portion 14 from the winding band end 12 as well as the length of this fastener or closure part or portion 14 is dimensioned in such a manner that this fastener or closure part or portion 14 or at least a part thereof is located at the outermost wound convolution or coil 7' (FIG. 1) of the winding band 6.

Hence, when the winding band or tape 6 is wound on to the winding core member 2, the closure part or portion 13 located at the winding band end 12 is brought into coacting releasable connecting relationship with the other fastener or closure part or portion 14 of the burr fastener or closure device 13, 14. In this manner, there is releasably retained or secured the free winding band end 12. As will be still further described with reference to FIGS. 5 and 6, the winding band end 12 can be releasably retained by means of the burr fastener or closure device 13, 14, also when printed products or the like are wound-on to the winding core or mandrel member 2.

In FIG. 1 the package support device 1 is shown in an empty condition or state, that is to say, prior to winding-up of printed products or the like thereupon. The predominant portion of the winding band or tape 6 is wound into the substantially ring-shaped recess or groove 4 located at the winding core member 2. This substantially ring-shaped recess or groove 4 is covered by the cover or closure member 8. The winding band or tape 6 is guided through the throughpass opening or passage 9 and is wound with several convolutions or coils 7*a* upon the outer or external surface 8*a* of the cover member 8. As already explained, the winding band end 12 is releasably fixedly retained or held at the next wound or next innermost situated band or tape convolution or coil 7' by the action of the burr fastener or closure device 13, 14.

In the illustration of FIGS. 5 and 6, there has been depicted the package support device 1, shown and discussed previously in relation to FIGS. 1 to 4, with the thereon wound printed products, such as newspapers, inserts, magazines or periodicals, or the like. In FIG. 6 in particular, there has been shown the finished or completely wound product package 15, whereas in FIG. 5 there has been illustrated the condition where only a part or portion 15*a* of the product package 15 has been formed. As will be apparent from the illustration of FIG. 5, the wound product package 15 comprises individual wound product convolutions or coils 16 formed by the wound printed products and between which there has been wound-up or convoluted the winding band or tape 6 or the like. The individual winding band convolutions or coils have been conveniently designated by reference numeral 17 in FIGS. 5 and 6. It will be observed, however, that in the illustration of FIG. 6 the outermost winding band convolution or coil, which corresponds to the outermost winding band convolution or coil 7' in the showing of FIGS. 1 and 4 and which carries the fastener part or portion 14 of the burr fastener or closure device 13, 14, is there designated by reference character 17'.

In the case of the finished wound product package 15 portrayed in FIG. 6, the fastener or closure part or portion 13 of the burr fastener or closure device 13, 14, located at the free end 12 of the winding band or tape 6 coacts with the burr fastener or closure part or portion 14 located at the outer side of the next winding band convolution or coil 17'.

Based upon the illustrations of FIGS. 7, 8, 9 and 10 there will now be explained by way of example the manner in which there may be formed a wound product package 15.

It will be observed that in such FIGS. 7, 8, 9 and 10 there has only been schematically depicted a winding station, here shown as a wind-up station 20. Such wind-up station 20 is of conventional construction and, for instance, is quite similar to the wind-up stations which have been disclosed in greater detail in the aforementioned Swiss Pat. No. 652,379 and the cognate U.S. Pat. No. 4,532,750 and British Patent No. 2,106,872 and the German Pat. No. 3,123,888 and the cognate U.S. Pat. No. 4,438,618, granted Mar. 27, 1984, to which reference may be readily had and the disclosures of which are incorporated herein by reference. This wind-up station 20 comprises a product infeed arrangement or device here shown in the form of a band or belt conveyor 21 which is designed as a rocker or balance structure and is pivotably mounted for pivotable movement about the axis 21*a* in a frame or stand 22. This band or belt conveyor 21 is provided with a here only schematically illustrated detachment or release arrangement 23 which serves, in a manner still further to be described in greater detail, to engage and release or detach the winding band end 12.

The detachment or release arrangement 23 can be constructed, for instance, similar to the winding band detachment or release device illustrated and described in the aforementioned Swiss Pat. No. 652,379 and the corresponding U.S. Pat. No. 4,532,750. Furthermore, at the frame or frame member 22 there is mounted a take-up spool member or spool 24 for the winding band or tape 6 and which can be operatively coupled with any suitable and therefore here not particularly illustrated drive or drive means, as is well known in this technology.

Prior to the start of the wind-up operation a package support or carrier device 1 which is empty, as shown in FIG. 1, is appropriately mounted at the wind-up station 20. In this empty condition or state of the package support device 1, and as already explained, there are wound-up a number of band convolutions or coils 7*a* of the winding band or tape 6 onto the outer or external surface 8*a* of the cover member 8.

Figure 7:
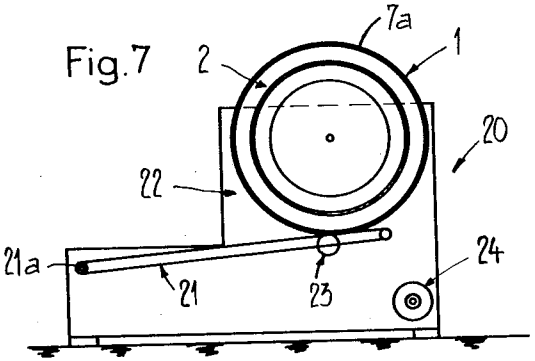
Figure 8:
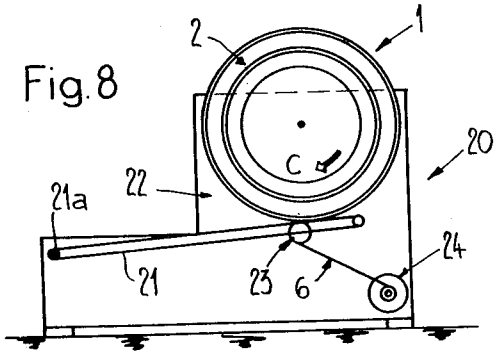

In FIG. 7 there has been depicted the empty package support device 1 which has been mounted or installed at the wind-up station 20. This package support device 1 is now rotated by any suitable and thus not illustrated drive or drive means in the direction of the arrow C, as shown in FIG. 8, and as is also well known in this technology. The detachment or release arrangement or device 23 now engages the free band end 12 of the winding band or tape 6, detaches such from the next band convolution or coil 7' and deflects or guides the winding band or tape 6 which has been withdrawn during further rotation of the winding core or mandrel member 2 in the direction towards the take-up or receiver spool or spool member 24. The unwound winding band 6 is guided to the take-up spool member 24 which likewise is provided with a fastener or closure part or portion of, for instance, a burr fastener or closure device which is placed into coacting relationship with the fastener or closure portion 13 provided at the band end 12 at the winding band or tape 6. The winding band 6 which has been wound-off of the winding core member 2 is now wound-up upon the driven take-up spool member or spool 24.

As soon as there has been unwound the outer situated group of band convolutions or coils 7*a* of the winding band or tape 6 and which were previously reposing upon the cover or closure member 8 then there is stopped the rotational movement of the winding core member 2. Now the cover or closure member 8 is displaced in the direction of the arrow B, so that the substantially ring-shaped recess or groove 4 and the band convolutions or coils 7 of the winding band or tape 6 which are located in such substantially ring-shaped recess or groove 4 are exposed or laid free, as the same has been depicted in FIG. 2. Now the winding core member is again rotated in the direction of the arrow C an the take-up spool member 24 again placed into rotation. As a result the winding band or tape 6 is unwound from the winding core member 2 and is wound up upon the take-up spool member 24. As soon as the required winding band length has been unwound from the winding core member 2 as needed for the formation of the contemplated wound product package 15 and has been wound-up upon the take-up spool member 24 then the drive devices or units for the winding core member 2 and the take-up spool member 24 are stopped. The cover or closure member 8 is now displaced back in the direction of the arrow B' (FIG. 3) so that for the subsequent wind-up operation the substantially ring-shaped recess or groove 4 is again covered. The not required winding band length of the winding band or tape 6 remains upon the winding core member 2 and is located in the substantially ring-shaped recess or groove 4 as such has been depicted in FIG. 3.

Figure 9:
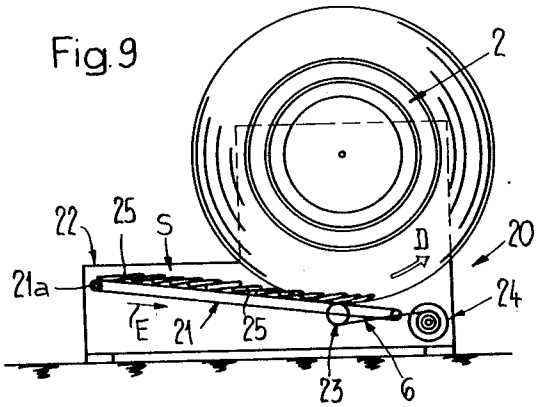
FIGS. 7, 8, 9 and 10 depict in side view and schematically a winding station, here a wind-up station for the printed products or the like, illustrating different phases of the operation of winding-u of such printed products.

To wind-up the inbound printed products 25 or the like arriving in an imbricated or shingled formation S, as the same has been shown in FIG. 9, and which are delivered or infed by the band or belt conveyor 21 to the winding core member 2, the latter is driven in the direction of the arrow D (FIG. 9) whereas the take-up spool member is slightly appropriately braked, again as is well known in this technology. The printed products 25 together with the winding band or tape 6 which has been unwound from the take-up spool member 24 is wound up onto the winding core member 2, all as explained in greater detail in the previously mentioned patent documentation. It will be recognized that the innermost product package convolution 16 comes to bear upon the support or bearing surface 3 of the winding core member 2 and upon the cover or closure member 8 which overlies the substantially ring-shaped recess or groove 4, as such has been depicted in FIG. 5. The winding band convolutions or coils 17 pass over the cover or closure member 8 which prevents such winding band convolutions or coils 17 and thus also the wound-up printed products 25 from being drawn or retracted into the substantially ring-shaped recess or groove 4.

Figure 10:
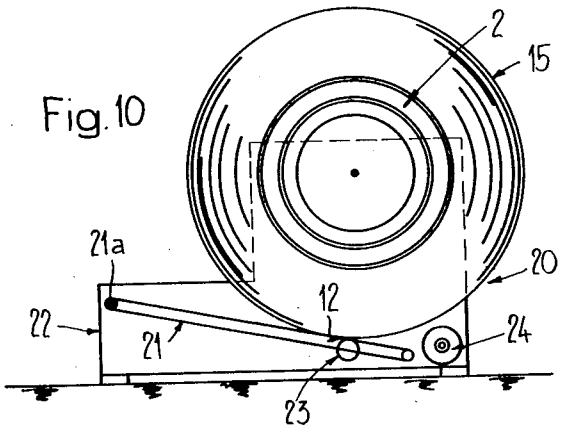

As will be recognized by referring to FIG. 10, once the wound product package 15 has been completed then the winding band 6 is completely unwound from the take-up spool member 24. The free end 12 of the winding band 6 is now pressed against the next situated winding band convolution or coil 17' where, as already explained, it is releasably fixedly held by means of the burr fastener or closure device 13, 14 or equivalent structure. The finished wound product package 15, which has been depicted in FIG. 6, can now be removed from the wind-up station 20 and transferred or transported to an intermediate storage or to a further processing station.

The unwinding of the printed products 25 from the wound product package 15 is accomplished at a wind-off or unwinding station which is similarly constructed to the wind-up station 20. During unwinding of the previously wound product package 15, the unwinding operation is accomplished in the reverse sequence to that previously described. The winding band end 12 is delivered to the take-up spool member 24 and is releasably secured thereat. Thereafter the take-up spool member 24 is placed into rotation, causing a winding-up of the winding band or tape 8 and an unwinding of the printed products 25 from the prior wound product package 15. The unwound printed products 25 are outfed by the band or belt conveyor 21 or equivalent structure. If the winding core member 2 is now in an empty state, then the cover or closure member 8 is displaced in the direction of the arrow B (FIG. 2) and the substantially ring-shaped recess or groove 4 is exposed. By driving the winding core member 2 the winding band or tape 6 is unwound from the take-up spool member 24 and wound up on the winding core member 2, and such winding band or tape 6 now comes to lie in the substantially ring-shaped recess or groove 4. Towards the end of this rewinding operation, the winding core member 2 is stopped, the cover or closure member 8 is displaced back in the direction of the arrow B' (FIG. 3) and thereafter the outer winding convolutions or coils 7*a* of the winding band or tape 6 are wound upon the cover or closure member 8, so that there can be again obtained an empty package support device 1, as the same has been depicted in FIG. 1.

It is also conceivable that when the winding band 6 has been wound onto the winding core member 2 that this winding band 6 is completely accommodated or received in the substantially ring-shaped recess or groove 4. With this proposal it would then be necessary to displace or shift back the cover or closure member 8 prior to the start of the unwinding operation in order to unwind this winding band or tape 6. Additionally, the detachment or release arrangement 23 must be constructed such that it is capable of engaging or entering the open substantially ring-shaped recess or groove 4 in order to seize and release the winding band end 12.

Figure 11:
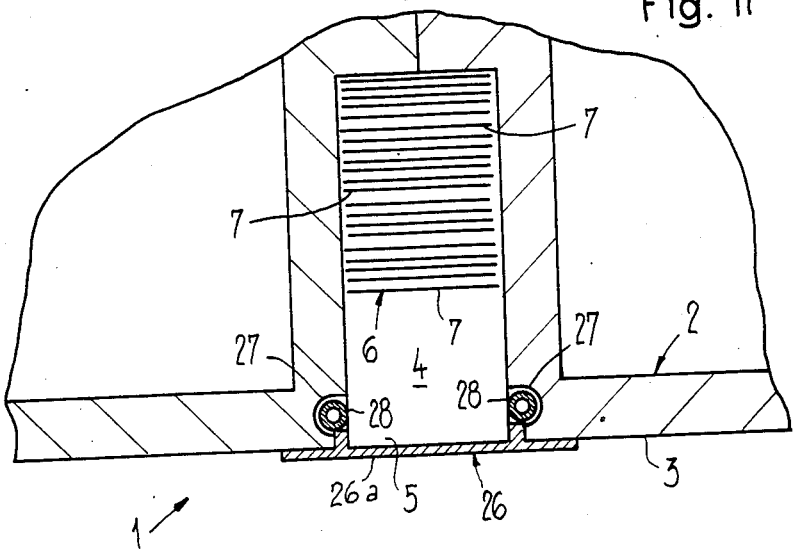
FIG. 11 is a fragmentary sectional view of part of a modified construction of package support device according to a second exemplary embodiment of the invention.
Figure 12:
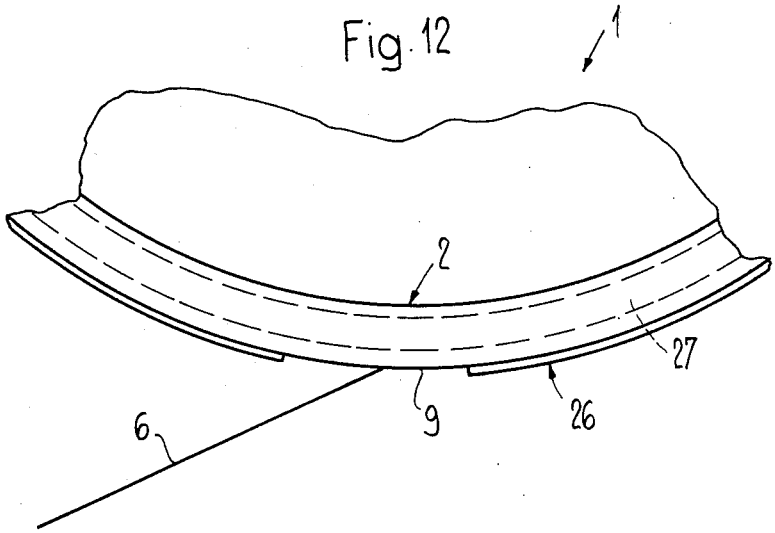
FIG. 12 is a fragmentary side view of the modified construction of package support device depicted in FIG. 11.

Turning attention now to FIGS. 11 and 12, there is depicted therein a different construction of package support or carrier device 1. This modified embodiment differs from the package support device 1 depicted and discussed previously with reference to FIGS. 1 to 4 only fundamentally by virtue of a different construction of the cover or closure member. In contrast to the cover or closure member B illustrated in the arrangement of FIGS. 1 to 4 here the substantially ring-shaped cover or closure member 26 located at the package support device 1 of the arrangement of FIGS. 11 and 12 is not fixedly connected for rotation or co-rotation with the rotatable winding core member 2, rather is rotatably arranged with respect to the winding core member 2 about the lengthwise axis 2a of such winding core member 2. In order to render possible such relative rotational movement between the cover member 26 and the winding core member 2, the latter is provided with guide grooves 27 with which engage the guide bodies or portions 28 of the cover member 26, as such will be particularly evident by inspecting FIG. 11.

Since the cover member 26 during unwinding of the winding band or tape 6 from the winding core member 2 can rotate with respect to such winding core member 2, it is no longer necessary to displace the cover member 26 towards the side or laterally in order to free or expose the substantially ring-shaped recess or groove 4. The cover member 28 is here rotated into a predeterminate position where the throughpass opening or passage 9 for the winding band or tape 6 assumes the proper posture or position. The cover member 26 remains, during the unwinding operation, in this position, but in this case there is necessary an arresting device, as such will be explained more fully hereinafter with respect to the embodiment of FIGS. 13 and 14.

Also with the exemplary embodiment depicted in FIGS. 11 and 12 it is possible, just as was the case for the embodiment of FIGS. 1 to 4, to wind several band convolutions or coils of the winding band or tape 6 onto the outer surface 26a of the cover or closure member 26. However, also in the case of this second exemplary embodiment portrayed in FIGS. 11 and 12, it is possible to completely accommodate or house the winding band or tape 6 in the substantially ring-shaped recess groove 4. In that case, it will be necessary to provide suitable means or expedients in order to engage the free band end 12 of the winding band 6 and to guide such through the throughpass opening or passage 9 out of the closed substantially ring-shaped recess or groove 4. An appropriate solution in this regard is depicted and will be explained hereinafter with reference to FIGS. 13 and 14.

Figure 13:
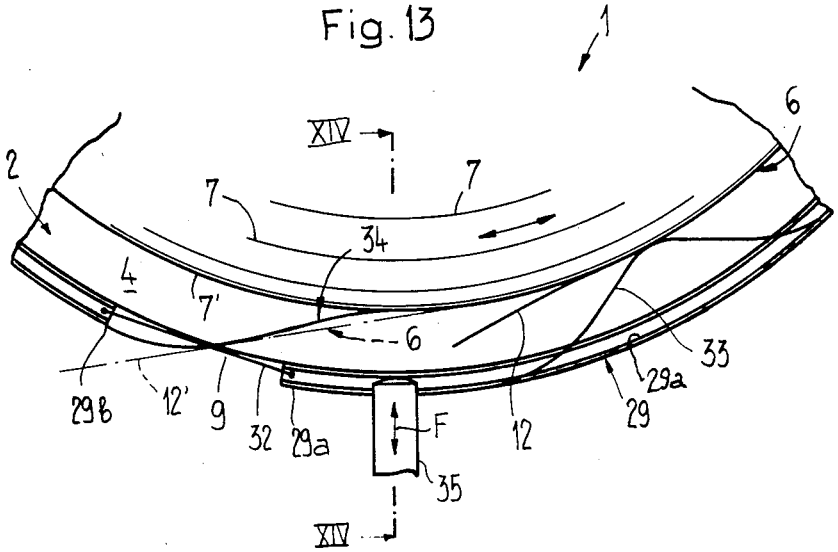
FIG. 13 is a schematic cross-sectional view illustrating part of a package support device according to a third exemplary embodiment of the present invention.
Figure 14:
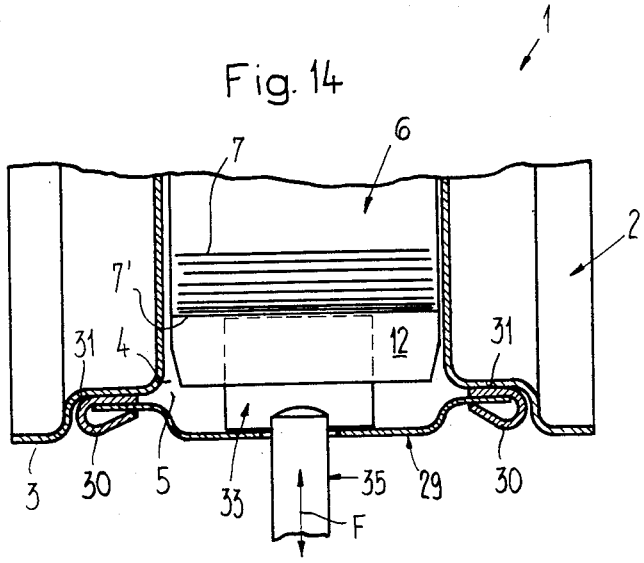
FIG. 14 is a sectional view of part of the modified construction of package support device depicted in FIG. 13, taken substantially along the line XIV—XIV thereof.

Turning attention now to the third exemplary embodiment shown in FIGS. 13 and 14, it will be recognized that the substantially ring-shaped cover or closure member 29, just like the embodiment of FIGS. 11 and 12 previously discussed, is rotatable relative to the rotatable winding core or mandrel member 2. The cover member 29 is constructed as an open or non-continuous ring or ring member, the ends 29a and 29b of which define the throughpass opening or passage 9 for the winding band 6, as particularly evident by referring to FIG. 13. At the side edges of the cover member 29 there are secured slide elements 30 (FIG. 14) by means of which the cover member 29 can slide upon guide tracks or members 31 or the like, provided at the winding core member 2 and which are set back or inwardly displaced in relation to the support or bearing surface 3 for the wound-up printed products. Both ends 29a and 29b of the cover member 29 are connected with one another by means of one or a number of connection or securing elements 32, as depicted in FIG. 13. The connection or securing element 32 or the connection or securing elements 32, as the case may be, afford the possibility of realizing a certain change in the diameter of the cover member 29, so that such cover member 29, during winding-up of the printed products, can fixedly bear at or contact the winding core member 2, whereas this cover member 29 loosely bears at the winding core member 2 during unwinding of the winding band or tape 6 from the winding core member 2.

At the inner side or surface 29a of the cover member 29, there is arranged thereat a contact or pressing spring or spring member 33 or equivalent structure, which presses the free end 12 of the winding band or tape 6 against the therebelow situated band convolution or coil 7'. By providing such contact or pressing spring or resilient element 33, the fastener part or portion 13, not particularly depicted in FIGS. 13 and 14 of the, for instance, burr fastener or closure device 13, 14, will be pressed against the likewise not here shown fastener or closure part or portion 14 located at the next band convolution or coil 7'. During rewinding of the winding band or tape 6 into the substantially ring-shaped recess or groove 4, this contact or pressing spring or spring member 33 ensures that the free winding band end 12 will be releasably connected with the next band convolution or coil 7' located therebeneath.

At the region of the throughpass opening or passage 9, there is further arranged at the cover member 29 a detachment or release spring or spring member 34 (or a number of such detachment or release springs), as will be seen by inspecting FIG. 13, and which bears at the outermost complete band convolution or coil 7'. During rotation of the winding core member 2 this detachment or release spring member 34 engages beneath the free band end 12 and detaches such from the therebelow situated band convolution or coil 7'. The detachment or release spring member 34 additionally ensures that the now detached free band end 12 will be guided outwardly through the throughpass opening or passage 9, as such has been indicated in FIG. 13 by the chain-dot illustrated band end 12'. To prevent rotation of the cover member 29 and thus the detachment or release spring or spring member 34, there is provided a here only schematically illustrated arresting bolt member 35 or equivalent structure which can be selectively shifted or displaced in the direction of the double-headed arrow F and can be brought into engagement with the cover or closure member 29.

With the exemplary embodiment depicted in FIGS. 13 and 14, the winding band or tape 6 which has been wound upon the winding core member 2 is located completely within or internally of the substantially ring-shaped recess or groove 4 which is covered at its outer region or opening by the cover or closure member 29.

With both exemplary embodiments depicted in FIGS. 11 and 12 and FIGS. 13 and 14, respectively, the winding-off of the winding band or tape 6 from the winding core member 2 and the subsequent winding-up of the printed products 25, is basically accomplished in the same fashion as such has been previously described with respect to FIGS. 7, 8, 9 and 10.

It should be understood that the previously disclosed exemplary embodiments also can be differently constructed as to various components or parts thereof than has been described by wa of illustration and not limitation. Thus, it is possible, for instance, to provide instead of a burr fastener or closure device for the releasable connection of the free band end 12 of the winding band or tape 6 with the winding band convolution or coil 7' or 17', as the case may be, located therebeneath, a different solution. In particular, the free band end 12 of the winding band or tape 6 can or can be provided with The section of the winding band or tape 6 which forms the next or outermost completed winding band convolution or coil 7' or the next or outermost completed winding band convolution or coil 17', as the case may be, must then be formed throughout an appropriate length thereof from a magnetizable material, so that the free winding band end 12 can adhere by magnetic force to the next or outermost winding band convolution or coil 7' or the next or outermost completed winding band convolution or coil 17', as the case may be. Hence, the elements or parts designated in the foregoing description by reference characters 13 and 14, can be conceptually considered as constituting such magnetic fastener device or expedient.

It will also be conceivable, similar to the winding body or winding body member described in the aforementioned Swiss Pat. No. 652,379 and the corresponding U.S. Pat. No. 4,532,750, to wind the winding band or tape 6 which is accommodated in the substantially ring-shaped recess or groove 4 upon a core which is rotatable with respect to the winding core member 2 surrounding such core. In contrast to the illustrated exemplary embodiment, such solution is, however, afflicted with the shortcoming that in addition to the drive for the winding core member 2, there would also be required a drive or drive means for rotating the winding band core.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A package support device for the intermediate storage of wound-up printed products, especially newspapers inserts, periodicals, magazines and the like, comprising:

a rotatable winding core member provided with a substantially cylindrical support surface bearing thereon wound-up printed products;

a winding band provided for said rotatable winding core member and capable of being wound in convolutions between convolutions of the wound-up printed products;

said winding band being connected at one end with the rotatable winding core member;

said rotatable winding core member comprising a substantially ring-shaped recess defining an opening;

said substantially ring-shaped recess being open in the direction of said substantially cylindrical support surface of said rotatable winding core member;

said substantially ring-shaped recess extending in circumferential direction of said rotatable winding core member and serving to accommodate therein at least a predeterminate portion of said winding band; and a cover member for covering the opening of said substantially ring-shaped recess and enabling winding-up of the winding band into the substantially ring-shaped recess of the rotatable winding core member and unwinding of the winding band from said substantially ring-shaped recess of the rotatable winding core member.

2. The package support device as defined in claim 1, wherein:

said cover member possesses a substantially ring-shaped configuration.

3. The package support device as defined in claim 2, wherein:

said cover member possesses a throughpass opening for the winding band.

4. The package support device as defined in claim 1, wherein: said cover member possesses a throughpass opening for the winding band.

5. The package support device as defined in claim 1, wherein:

said rotatable winding core member has an axial direction of extent;

means for connecting said cover member so as to conjointly rotate with said rotatable winding core member;

said cover member being displaceable in said axial direction of extent of said rotatable winding core member.

6. The package support device as defined in claim 1, wherein:

said rotatable winding core member has a lengthwise axis; and means for rotatably mounting said cover member at said rotatable winding core member so as to be rotatable relative to said rotatable winding core member about said lengthwise axis of said rotatable winding core member.

7. The package support device as defined in claim 6, wherein:

said cover member possesses a substantially ring-shaped configuration;

said cover member having a circumferential length; and means for altering the circumferential length of said substantially ring-shaped constructed cover member.

8. The package support device as defined in claim 1, wherein:

said winding band has an end remote from said one end connected with said rotatable winding core member and defining a free end; and means for releasably connecting said free end of said winding band, when completely wound into a plurality of band convolutions at said rotatable winding core member, with a next inwardly situated band convolution.

9. The package support device as defined in claim 8, wherein:

said rotatable winding core member has an axial direction of extent;

means for connecting said cover member so as to conjointly rotate with said rotatable winding core member;

said cover member being displaceable in said axial direction of extent of said rotatable winding core member;

detachment means arranged externally of said rotatable winding core member; and said detachment mean serving for the detachment of the free end of the winding band from the next inwardly situated band convolution.

10. The package support device as defined in claim 9, wherein:

said cover member has an outer surface; and said free end of said winding band being arranged at the outer surface of the cover member which covers said substantially ring-shaped recess of the rotatable winding core member.

11. The package support device as defined in claim 8, wherein:

said cover member has an outer surface; and said free end of said winding band being arranged at the outer surface of the cover member which covers said substantially ring-shaped recess of the rotatable winding core member.

12. The package support device as defined in claim 8, wherein:

said releasably connecting means comprises a releasable fastener device.

13. The package support device as defined in claim 12, wherein:

said releasable fastener device comprises a burr fastener device.

14. The package support device as defined in claim 13, wherein:

said burr fastener device is a Velcro fastener device.

15. The package support device as defined in claim 8, wherein:

said releasably connecting means comprises magnetic fastener means.

16. The package support device as defined in claim 1, wherein:

said winding band possesses an end remote from said one end connected with said rotatable winding core member and defining a free end; and said free end of said winding band, when said winding band is wound at said rotatable winding core member into a plurality of band convolutions, is located internally of said substantially ring-shaped recess of said rotatable winding core member.

17. The package support device as defined in claim 16, wherein:

said rotatable winding core member has a lengthwise axis;

means for rotatably mounting said cover member at said rotatable winding core member so as to be rotatable relative to said rotatable winding core member about said lengthwise axis of said rotatable winding core member;

said winding band has an end remote from said one end connected with said rotatable winding core member and defining a free end;

means for releasably connecting said free end of said winding band, when completely wound into a plurality of band convolutions at said rotatable winding core member, with a next innermost situated band convolution;

contact means for pressing the free end of the winding band against a next inwardly situated band convolution; and said contact means being arranged at said cover member.

18. The package support device as defined in claim 16, wherein:

said rotatable winding core member has a lengthwise axis;

means for rotatably mounting said cover member at said rotatable winding core member so as to be rotatable relative to said rotatable winding core member about said lengthwise axis of said rotatable winding core member;

said winding band has an end remote from said one end connected with said rotatable winding core member and defining a free end;

means for releasably connecting said free end of said winding band when completely wound into a plurality of band convolutions at said rotatable winding core member, with a next inwardly situated band convolution;

detachment means arranged at said cover member; and said detachment means serving for detachment of the free end of the winding band from the next inwardly situated band convolution.

19. The package support device as defined in claim 1, further including:

arresting means for securing said cover member against co-rotation with said rotatable winding core member.

20. The package support device as defined in claim 1, wherein:

said rotatable winding core member has a lengthwise axis;

said support surface of said rotatable winding core member having a central region; and said substantially ring-shaped recess of said rotatable winding core member being arranged approximately at said central region of said support surface of said rotatable winding core member and being disposed in a plane extending substantially at right angles to said lengthwise axis of said rotatable winding core member.

21. A package support device for the intermediate storage of wound-up products, comprising:

a rotatable winding core member provided with a substantially cylindrical support surface carrying thereon wound-up products;

a winding tape provided for said rotatable winding core member and capable of being wound in convolutions between convolutions of the wound-up printed products;

said winding tape being connected with the rotatable winding core member;

said rotatable winding core member being provided with groove means;

said groove means being open in the direction of said substantially cylindrical support surface of said rotatable winding core member;

said groove means serving to accommodate therein at least a predeterminate portion of said winding tape; and means for covering said groove means and enabling winding-up of the winding tape into the groove means of the rotatable winding core member and unwinding of the winding tape from said groove means of the rotatable winding core member.

* * * * *